US009243410B1

(12) United States Patent
Garber

(10) Patent No.: US 9,243,410 B1
(45) Date of Patent: Jan. 26, 2016

(54) SNOW GUARD SUPPORT

(71) Applicant: Amos Garber, Leesburg, OH (US)

(72) Inventor: Amos Garber, Leesburg, OH (US)

( * ) Notice: Subject to any disclaimer, the term of this patent is extended or adjusted under 35 U.S.C. 154(b) by 0 days.

(21) Appl. No.: 14/752,848

(22) Filed: Jun. 27, 2015

(51) Int. Cl.
*E04D 13/10* (2006.01)

(52) U.S. Cl.
CPC ..... *E04D 13/10* (2013.01)

(58) Field of Classification Search
CPC ..... E04D 13/10
USPC ..... D8/499; 52/24, 25, 26, 533
See application file for complete search history.

(56) References Cited

U.S. PATENT DOCUMENTS

| | | | | | |
|---|---|---|---|---|---|
| 507,776 | A | | 10/1893 | Berger et al. | |
| 595,295 | A | | 12/1897 | Fox et al. | |
| D33,009 | S | * | 7/1900 | Fulmer | D8/499 |
| 884,850 | A | | 4/1908 | Peter | |
| 933,784 | A | | 9/1909 | Peter | |
| 1,095,822 | A | * | 5/1914 | Danzer | 52/25 |
| 1,330,309 | A | | 2/1920 | Dixson | |
| 1,366,703 | A | * | 1/1921 | Peter | 52/24 |
| D109,697 | S | * | 5/1938 | Cody | D8/499 |
| 2,201,320 | A | | 5/1940 | Place | |
| 3,289,361 | A | * | 12/1966 | Holliday | 52/24 |
| 3,296,750 | A | * | 1/1967 | Zaleski | 52/24 |
| 4,141,182 | A | * | 2/1979 | McMullen | 52/24 |
| 5,271,194 | A | | 12/1993 | Drew | |
| 5,282,340 | A | * | 2/1994 | Cline et al. | 52/24 |
| D351,989 | S | * | 11/1994 | Cline et al. | D8/499 |
| D364,338 | S | * | 11/1995 | Cline | D8/499 |
| D364,556 | S | * | 11/1995 | Lee et al. | D8/499 |
| 5,471,799 | A | * | 12/1995 | Smeja et al. | 52/24 |
| 5,522,185 | A | | 6/1996 | Cline | |
| D372,421 | S | * | 8/1996 | Cline | D8/499 |
| 5,732,513 | A | | 3/1998 | Alley | |
| 5,943,826 | A | * | 8/1999 | Totin | 52/24 |
| D418,403 | S | | 1/2000 | Cline | |
| 6,499,259 | B1 | | 12/2002 | Hockman | |
| D482,604 | S | * | 11/2003 | Smeja et al. | D8/499 |
| D495,595 | S | * | 9/2004 | Dressler | D8/499 |
| D499,011 | S | * | 11/2004 | Rizzo | D8/499 |
| D499,331 | S | * | 12/2004 | Dressler | D8/499 |
| D499,332 | S | * | 12/2004 | Rizzo | D8/499 |
| D511,451 | S | * | 11/2005 | Mullane | D8/499 |
| 7,127,852 | B1 | * | 10/2006 | Dressler | 52/24 |
| D537,336 | S | * | 2/2007 | Fisher | D8/499 |
| 7,516,576 | B1 | | 4/2009 | Mullane | |
| D601,414 | S | * | 10/2009 | Riley et al. | D8/499 |
| D610,443 | S | * | 2/2010 | Fisher | D8/499 |
| D610,444 | S | * | 2/2010 | Fisher | D8/499 |
| D617,181 | S | * | 6/2010 | McMullen | D8/499 |
| 7,774,989 | B2 | | 8/2010 | Fisher | |
| D625,176 | S | * | 10/2010 | Fisher | D8/499 |
| D657,236 | S | * | 4/2012 | Knutsen | D8/499 |
| D658,491 | S | * | 5/2012 | Raber | D8/499 |

(Continued)

*Primary Examiner* — Elizabeth A Plummer
*Assistant Examiner* — Kyle Walraed-Sullivan

(57) ABSTRACT

A snow guard has an upper plate having a neck portion connected to a head portion having an upper edge which includes a medially extending recessed surface and a base portion connected to the neck portion along a transverse stamped bend line, the base portion including a first pair of longitudinal stamped bend lines extending approximate said neck portion through to a bottom edge of the base portion which defines a mid base portion and a side base portion on each side of each the respective first longitudinal stamped bend line, wherein the bottom edge of said base portion is less length than a length of the medially extending recessed surface to reduct cost and waste of the snow guard.

8 Claims, 2 Drawing Sheets

(56) References Cited

U.S. PATENT DOCUMENTS

| | | | | | |
|---|---|---|---|---|---|
| D685,257 | S | * | 7/2013 | Beamer et al. | D8/499 |
| D685,258 | S | * | 7/2013 | Beamer et al. | D8/499 |
| D685,259 | S | * | 7/2013 | Beamer et al. | D8/499 |
| D685,627 | S | * | 7/2013 | Beamer et al. | D8/499 |
| D689,359 | S | * | 9/2013 | Fisher | D8/499 |
| D689,763 | S | * | 9/2013 | McCarthy | D8/499 |
| 2003/0182870 | A1 | * | 10/2003 | Smeja et al. | 52/24 |
| 2005/0115162 | A1 | * | 6/2005 | Nee | 52/24 |
| 2005/0193650 | A1 | * | 9/2005 | Hockman | 52/198 |
| 2005/0257434 | A1 | * | 11/2005 | Hockman | 52/24 |
| 2007/0271855 | A1 | * | 11/2007 | Stearns | 52/24 |
| 2009/0266003 | A1 | * | 10/2009 | Riley et al. | 52/24 |
| 2010/0000161 | A1 | * | 1/2010 | Fisher | 52/26 |
| 2013/0167453 | A1 | * | 7/2013 | Clisset | 52/26 |
| 2014/0318032 | A1 | * | 10/2014 | McCarthy | 52/24 |

* cited by examiner

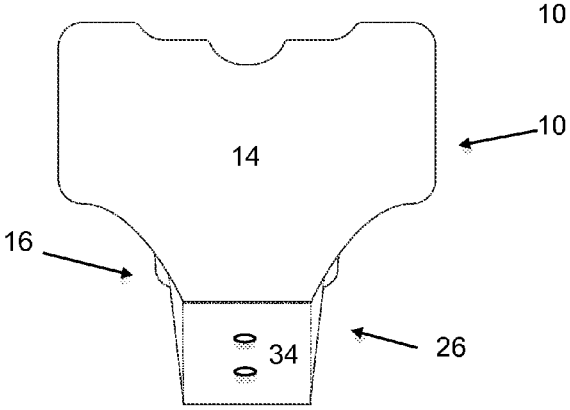
FIG. 1
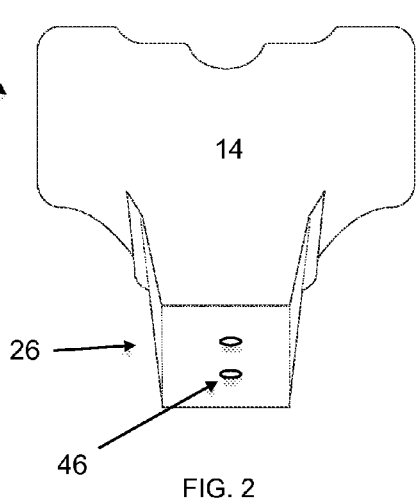
FIG. 2
FIG. 5
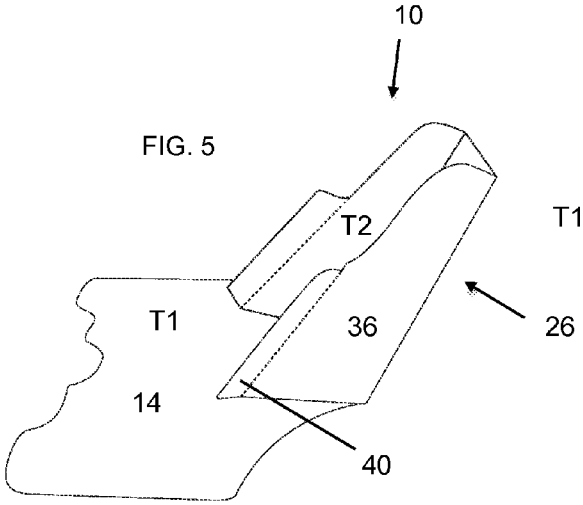
FIG. 6
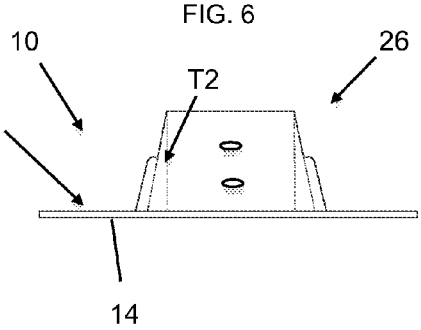
FIG. 3
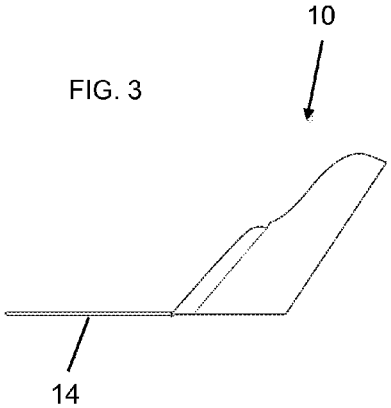
FIG. 4
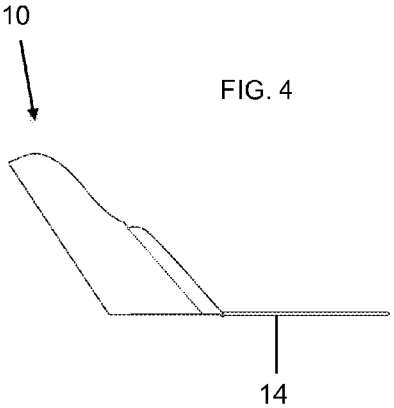

SNOW GUARD SUPPORT

This application claims the benefit of an earlier filed application U.S. Ser. No. 29/531,196 filed Jun. 24 2015.

BACKGROUND OF THE INVENTION

Field of Invention

Snow guards have long been employed for fixed mounting to the lower ends of inclined building roofs, particularly in areas of the roof carrying gutters or other water collecting systems and above such gutters or water collecting systems to prevent the movement of snow or ice that accumulates from damaging the gutters or water collection systems. In addition, snow guards are used for preventing large sheets of ice or snow from sliding and falling from roofs harming persons or objects below.

As snow accumulates on a roof, warmth from the sun tends to melt the underlying layer of snow as water flows through the snow and runs along the roof and drips off edges of the roof. In the case of seam metal roofs, the water makes the roof surface slick and heavy sheets of snow or ice slide off the roof.

Snow guards are employed to prevent snow or ice formed on the roof are retained until they melt or slide off in much smaller pieces. Snow guards attach to the roof either on the seam, adjacent the seam or between the seams using various connection methods.

Snow guards of the type attached to the flat surface are typically employed on metal roofs and make holes through the roof but are quick and easy to install. Snow guards can be deformed under significant weight loads. A need exists for an improved snow guard which may be easily and inexpensively constructed, and which provide adequate support for snow and connection to the roof in a leakproof manner. Snow guards are easily seen from the ground, and thus it is desirable to have an aesthetically pleasing appearance which is also functionally acceptable.

SUMMARY OF THE INVENTION

It is an object to provide a snow guard which configured from a stamped metal sheet, which configuration reduces cost while maintaining high degree of functionality.

It is another object to provide an improved snow guard.

A further object is to provide an aesthetically pleasing and functional snow guard.

The present invention provides a lightweight snow guard for attachment on a flat surfaces of a metal roof.

The present invention is directed to a snow guard which is configured from a stamped metal sheet. The snow guard includes an upper plate having a neck portion connected to a head portion having an upper edge which includes a medially extending recessed surface extending partway therein.

A base portion connects the neck portion along a transverse stamped bend line. The base portion includes a first pair of longitudinal stamped bend lines extending approximate the connection of the neck portion through to a bottom edge of the base portion, and define a mid base portion, a side base portion on each side of the respective first longitudinal stamped bend line. The bottom edge of the base portion is less length than a length of said medially extending to reduct cost and waste of the snow guard. Additionally, the base portion includes a second pair longitudinal stamped bend lines outwardly disposed relative to first longitudinal stamped bend lines which define a wing base portion on each side base portion. The side base portions have upper edge extending outward from the connection to the neck portion and are at an incline. Wing base portions have an upper edge which are at a decline relative to the upper edge of each connecting side base portion. Between the first longitudinal stamped bend lines are openings for receiving connectors, such as screws therethrough.

In its formed configuration, the side base portions are bent at angle greater than 90 degrees relative a top surface the mid base portion. The wing base portions are bent at angle greater than 180 degrees relative a top surface of the respective side base portion to which it connects. The upper plate is bent at an angle greater than 90 degrees relative a top surface of the mid base portion and to a point such that the top surface of the upper plate contacts the upper edges of the base plate. These and further and other objects and features of the invention are apparent in the disclosure, which includes the above and ongoing written specification, with the claims and the drawings.

BRIEF DESCRIPTION OF THE DRAWINGS

FIG. 1 is a front view of a Snow Guard Support showing my invention;

FIG. 2 is a back view of a Snow Guard Support showing my invention;

FIG. 3 is a left side end view of a Snow Guard Support showing my invention;

FIG. 4 is a right side end view of a Snow Guard Support showing my invention;

FIG. 5 is a left side perspective view of a Snow Guard Support showing my invention;

FIG. 6 is a top view of a Snow Guard Support showing my invention; and

DETAILED DESCRIPTION OF THE DRAWINGS

Figure 7:
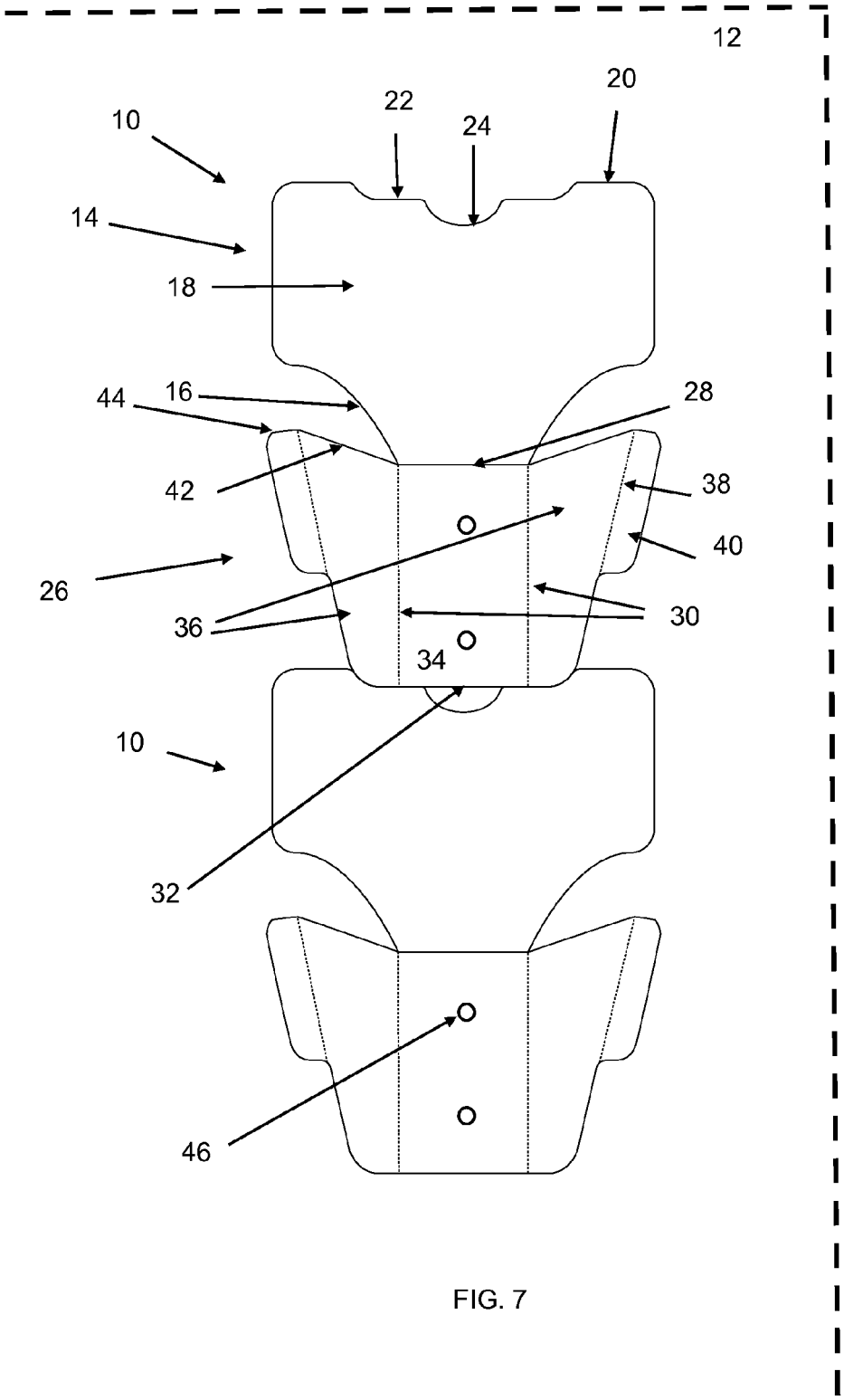
FIG. 7 depicts the invention in a sheet stamped configuration.

Referring now to drawings, a snow guard of the instant invention is generally indicated by the numeral 10. The snow guard 10 can be configured from a stamped metal sheet 12 which is represented by the dotted line. The snow guard 10 includes an upper plate 14 having a neck portion 16 connected to a head portion 18. The head portion has an upper edge 20 which includes a medially extending recessed surface 22 extending partway therein. The medially extending recessed surface 22 can include a central concave portion 24.

A base portion 26 connects the neck portion 16 along a transverse stamped bend line 28. The base portion 26 includes a first pair of longitudinal stamped bend lines 30 extending approximate the connection of the neck portion 16 through to a bottom edge 32 of the base portion 26, and which define a mid base portion 34 and a side base portion 36 on each side of the respective first longitudinal stamped bend lines 30. The bottom edge 32 of the base portion 26 is of less length than the length medial recessed surface 22 to reduct cost and waste of the snow guard in the formation process as seen in the sheet of FIG. 7.

Additionally, the base portion 26 includes a second pair longitudinal stamped bend lines 38 outwardly disposed relative to first longitudinal stamped bend lines 30 which define a wing base portion 40 on each side base portion 36. The side base portions 36 have an upper edge 42 extending outward from the connection to the neck portion 16 and are at an upward incline. Wing base portions 40 have an upper edge 44 which are at a decline relative to the upper edge 42 of each connecting side base portion 36. Between the first longitudinal stamped bend lines 30 are openings 46 for receiving connectors, such as screws therethrough.

In its formed configuration, the side base portions 36 are bent at angle greater than 90 degrees relative a top surface T1 of the mid base portion 34. The wing base portions 40 are bent at angle greater than 180 degrees relative a top surface T2 of the respective side base portion 36 to which it connects. The upper plate 14 is bent at an angle greater than 90 degrees relative top surface T1 of the mid base portion 34 and to a point such that top surface T1 of the upper plate 14 contacts the upper edges 42, 44 of the base plate 26. The base plate 26 (mid base portion 34, side base portions 36 and wing base portions 40) provide the structural strength for the upper plate 14 to prevent against bending or breaking.

A preferred embodiment of the snow guard 10 can span about 4 inches in width as can be seen in FIG. 7. The upper plate 14 can have a length of about 3 inches and the base plate 26 can have a length of about 2¼ inches. Note, the neck portion 16 can be tapered, here shown to be arcuate. This accommodates the incline in upper edge 42. The medially extending recessed surface 22 can preferably be from about ¼ to ½ inch depth from the upper edge 20. One of the openings 46 can preferably be disposed about ⅜ inch from bottom edge 32 and the other about 1⅜th inch from bottom edge 32.

Snow guards of the instant invention are fabricated from sheet metal such as steel. The metal snow guard 10 can be coated for resistance to corrosion. In addition, there is provided a strip of rubber 50 with a pressure sensitive adhesive as shown in FIG. 2, which can have coaxially aligned openings 52 to mate with openings 46 of mid base portion 34. The snow plate 10 can preferably be formed with curved outer edges to prevent injuries.

While the invention has been described with reference to specific embodiments, modifications and variations of the invention can be made without departing from the scope of the invention, as described in the claims.

What is claimed is:

1. A snow guard, comprising:

an upper plate having a neck portion connected to a head portion having an upper edge which includes a medially extending recessed surface extending partway in said upper edge; and a base portion connected to said neck portion along a transverse stamped bend line, said base portion including a first pair of longitudinal stamped bend lines extending approximate said neck portion through to a bottom edge of said base portion which defines a mid base portion and a side base portion on each side of each said respective first longitudinal stamped bend line, wherein said bottom edge of said base portion is less length than a length of said medially extending recessed surface to reduct cost and waste of the snow guard, wherein said base portion includes a second pair longitudinal stamped bend lines outwardly disposed relative to said first longitudinal stamped bend lines which define a wing base portion on each side base portion.

2. The snow guard of claim 1, wherein each said side base portion has and upper edge extending outward from the connection to said neck portion and which are at an incline.

3. The snow guard of claim 2, wherein said wing base portions have an upper edge which are at a decline relative to the upper edge of each connecting side base portion.

4. The snow guard of claim 1, which includes openings for receiving connectors between said first longitudinal stamped bend lines.

5. The snow guard of claim 1, each said side base portion are bent at angle greater than 90 degrees relative a top surface of said mid base portion.

6. The snow guard of claim 1, wherein said wing base portions are bent at angle greater than 180 degrees relative a top surface of said respective connected side base portion.

7. The snow guard of claim 1, wherein said upper plate is bent at an angle greater than 90 degrees relative a top surface of said mid base portion and to a point such that a top surface of said upper plate contacts upper edges of said base portion.

8. The snow guard of claim 1, wherein a bottom edge of a base plate of a second snow guard is stamped from said medially extending recessed surface of said upper plate of said snow guard, wherein said snow guard is configured from a single metal sheet.

* * * * *